United States Patent [19]

Leonard, III et al.

[11] 4,345,994

[45] Aug. 24, 1982

[54] METHOD FOR MONITORING THE EFFICIENCY OF RAW MATERIAL BENEFICIATION APPARATUS

[76] Inventors: Joseph W. Leonard, III, 322 Kenmore St.; Joseph W. Leonard, IV, 1243 Corvette St., both of Morgantown, W. Va. 26505

[21] Appl. No.: 213,677

[22] Filed: Dec. 5, 1980

[51] Int. Cl.[3] ..... B03B 13/06

[52] U.S. Cl. ..... 209/1; 209/172; 209/172.5; 73/440; 250/303

[58] Field of Search ..... 209/1, 172.5, 172, 511, 209/589; 73/32 R, 440; 250/302, 303

[56] References Cited

U.S. PATENT DOCUMENTS 2,957,989 10/1960 Hull ..... 250/303

FOREIGN PATENT DOCUMENTS 47-50187 12/1972 Japan ..... 73/440

OTHER PUBLICATIONS

Perry, Ed., Chemical Engineers' Handbook, 4th Ed., McGraw-Hill Book Co., NY, NY 1963, pp. 21-57.

*Primary Examiner*—Ralph J. Hill

*Attorney, Agent, or Firm*—Clair X. Mullen, Jr.

[57] ABSTRACT

A method for determining the efficiency of float-sink raw material separation units which achieve separation by specific gravity sorting of raw material in particle form introduced to a liquid bath. The efficiency is determined by introducing to the bath, with the raw material in particle form for separation, prepared particles of determined size and specific gravity and detecting the separation location of these prepared particles.

7 Claims, No Drawings

METHOD FOR MONITORING THE EFFICIENCY OF RAW MATERIAL BENEFICIATION APPARATUS

In the beneficiation of raw materials such as various ores and coal it is known to employ a float-sink classification process and apparatus wherein separation of usable material, such as coal from rock and other heavier refuse mateials, is achieved by gravity separation. In operations of this type in the well known manner there is provided a bath which is usually water or water mixed with sand or finely ground magnetite, and the raw material in particle form is introduced to the surface of this bath. In the case of coal, which could have a specific gravity of separation of approximately 1.60, the coal will float on the water and the rock and other refuse materials will sink. Although various adjustments may be made to equipment of this type to alter the separating action, such as varying the pulp density of the said material, varying the quantity of the water and raising or lowering wiers, it is difficult to obtain an objective basis for making any such changes. Hence, the efficiency of float-sink separation operations is generally poor.

It is accordingly an object of the present invention to provide a method for monitoring the separating efficiency of float-sink separation apparatus on a continuous basis so that changes may be made to the equipment to improve the efficiency of separation. This is achieved in an efficient and economical manner.

Broadly in the practice of the invention application thereof is made to any float-sink separation process and apparatus for specific gravity separation of raw materials in particulate form, such as coal. Further, it is applicable to any said apparatus or process wherein the raw material in particulate form is introduced for separation into a liquid bath such as water and wherein the particles are separated within the liquid bath in accordance with the specific gravity of the particles, with particles of relatively higher specific gravity sinking within the liquid bath and particles with relatively lower specific gravity floating within said bath. In the case of coal it is the material to be recovered that will float since coal has a lower specific gravity than the refuse material with which it is mingled. It is to be understood, however, that the invention is also applicable to the float-sink separation of material such as various ores, wherein the material to be recovered is heavier than the associated refuse material, and thus the material to be recovered would sink in the liquid bath with the refuse material floating.

In accordance with the invention prepared particles are provided for introduction to the bath with the raw material particles to be separated. The prepared particles are of known and determined size and specific gravity. They are introduced individually with the particulate raw material to be separated and these prepared particles are detected at one or more of the separation locations of the sink-float classification apparatus. By determining the total number of detected prepared particles at each detection and separation location and dividing said total number by the total number of prepared particles introduced to the bath it is possible to achieve a determination with respect to the efficiency of separation of a particular float-sink classification unit.

Preferably the prepared particles of determined size and specific gravity would be within consecutive specific gravity ranges or limits. In the case of coal, for example, a known number of prepared particles with the specific gravity ranges of 1.30 to 1.32, 1.40 to 1.42, 1.50 to 1.52 and so forth could be provided. In this manner, by dividing the total number of prepared particles detected within each specific gravity range at a given separation location by the total number of prepared particles introduced for each said specific gravity range a fraction related to the separation efficiency of material within each specific gravity range can be obtained for each collection or separation location. By plotting each fraction for each specific gravity range against the average specific gravity of said range, e.g. mid-point, a series of points may be obtained and plotted for all of the ranges to result in a "partition curve" (Tromp curve). This partition curve will represent a percentage of the partition distribution that is in error from the particular specific gravity, sink-float separation being monitored.

In the preferred practice of the method of the invention in monitoring a conventional float-sink coal separation operation, the apparatus to which the method is applied would have two separation locations. The "clean separation" would constitute the float coal product to be recovered and the "tailings separation" which would constitute the heavier refuse material such as rock. A device for detecting prepared particles would be provided at each of the two collection and separation locations. During the operation of the separation apparatus and while the particles of raw material are being introduced thereto for separation a single prepared particle within one of the specific gravity ranges as described hereinabove would be introduced with the material for separation. When the prepared particle passes through the apparatus and is detected by one of the detectors, the separation location at which it is detected is recorded, as well as its specific gravity. A second prepared particle is then introduced and this sequence is repeated by sequentially introducing prepared particles to the apparatus until information sufficient to construct a partition curve is obtained.

The prepared particles are provided with means for actuating detection devices located at at least one separation location in the sink-float classification unit to be monitored and preferably at each location. For this purpose radiation producing or magnetic field producing material and the like may be introduced to the particles and a suitable detector provided. Any conventional material emitting a detectable substance or providing otherwise for detection may be used in accordance with the invention, and the detecting mechanism does not constitute a part of the invention. Furthermore, the prepared particles may be simulated particles rather than actual particles of the material being separated by the particular float-sink classification unit. More specifically, in the float-sink separation of coal, the prepared particles for detection may be coated with a radioactive substance, such as technetium (Tc), and detection thereof would be achieved by the use of a conventional Geiger counter provided at each separation location where detection of prepared particles is desired. Technetium is a fission product of uranium not occurring in nature. It is obtained by the extraction of neutron-irradiated molybdenum in methyl ethyl ketone.

We claim:

1. In a float-sink separation process for specific gravity sorting of raw material in particulate form, such as coal, by introducing particles of said raw material for separation into a liquid bath wherein the particles are separated within said liquid bath in accordance with the specific gravity of the particles, wherein particles with relative higher specific gravity sink within said bath and particles with relative lower specific gravity float within said bath, a method for determining the efficiency of said separation, said method comprising sequentially introducing individually to said bath with said raw material particulates to be separated prepared particles of determined size and specific gravity, said prepared particles being of a plurality of specific gravities and each prepared particle being of a known size and individually detecting and recording the separation location of each individual prepared particle introduced to said bath.

2. The method of claim 1 wherein a detection means is located at at least one separation location and said prepared particles are provided with means for actuating said detection means when present at said separation location.

3. The method of claim 2 wherein said detection means is a Geiger counter and said means for actuating said detection means is a ratioactive substance.

4. The method of claim 2 wherein the number of prepared particles actuating said detection means are determined to provide a total number of detected particles at each detection location and said total number is divided by the total number of prepared particles introduced to said bath.

5. The method of claim 4 wherein the quantity of said prepared particles of determined size and specific gravity are totaled within a plurality of specific gravity ranges to provide a total number of prepared particles within each specific gravity range, and the number of prepared particles actuating said detection device within each specific gravity range is divided by the total number of prepared particles introduced to said bath within each said specific gravity ranges.

6. The method of claim 5 wherein a detection means is located at each collection location.

7. The method of claim 6 wherein a prepared particle is introduced after the immediately preceding prepared particle introduced has been detected.

* * * * *

UNITED STATES PATENT OFFICE

CERTIFICATE OF CORRECTION

Patent No. 4,345,994 Dated August 24, 1982

Inventor(s) Joseph W. Leonard III and Joseph W. Leonard IV

It is certified that error appears in the above-identified patent and that said Letters Patent are hereby corrected as shown below:

Claim 3, line 3, change "ratioactive" to --radioactive--.

Signed and Sealed this

*Twelfth* Day of *October 1982*

[SEAL]

*Attest:*

GERALD J. MOSSINGHOFF

*Attesting Officer* *Commissioner of Patents and Trademarks*